US009371118B2

(12) United States Patent
King et al.

(10) Patent No.: US 9,371,118 B2
(45) Date of Patent: Jun. 21, 2016

(54) SAFETY DEVICE FOR IMPROVED VISIBILITY OF WATER SPORTS PARTICIPANT

(71) Applicants: Mary Kate King, Barrington, IL (US); Michael Patrick King, Barrington, IL (US); Mikael Bäckström, Chicago, IL (US); Keith Alsberg, Evanston, IL (US)

(72) Inventors: Mary Kate King, Barrington, IL (US); Michael Patrick King, Barrington, IL (US); Mikael Bäckström, Chicago, IL (US); Keith Alsberg, Evanston, IL (US)

(73) Assignee: Michael Patrick King and Mary Kate King, Barrington, IL (US)

( * ) Notice: Subject to any disclaimer, the term of this patent is extended or adjusted under 35 U.S.C. 154(b) by 365 days.

(21) Appl. No.: 14/080,715

(22) Filed: Nov. 14, 2013

(65) Prior Publication Data

US 2014/0130234 A1 May 15, 2014

Related U.S. Application Data

(60) Provisional application No. 61/726,152, filed on Nov. 14, 2012.

(51) Int. Cl.

| | |
|---|---|
| ***B63C 9/00*** | (2006.01) |
| ***A41D 20/00*** | (2006.01) |
| ***G09F 21/02*** | (2006.01) |
| *G09F 17/00* | (2006.01) |

(52) U.S. Cl.

CPC . *B63C 9/00* (2013.01); *A41D 20/00* (2013.01); *G09F 21/026* (2013.01); *B63B 2201/00* (2013.01); *B63B 2201/20* (2013.01); *G09F 2017/0066* (2013.01)

(58) Field of Classification Search

CPC ..... G09F 17/00; G09F 21/026; G09F 2017/0066; A41D 19/024; A41D 19/0031; A41D 19/0051; A41D 20/00; B63C 9/21; B63C 9/00; B63C 9/0005; B63C 9/20; B63C 2009/131; B63B 2201/00; B63B 2201/20

USPC ..... 2/170, 160; 116/173; 114/315; 441/89, 441/122

See application file for complete search history.

(56) References Cited

U.S. PATENT DOCUMENTS

| | | | | | |
|---|---|---|---|---|---|
| 689,840 | A * | 12/1901 | Jensaen | A63B 31/04 | 2/160 |
| 1,624,429 | A * | 4/1927 | Palmer | A41D 19/0024 | 2/159 |
| 1,670,176 | A * | 5/1928 | Woolery | G08B 5/02 | 116/173 |
| 2,223,029 | A * | 11/1940 | Dunton | A41D 19/0024 | 150/117 |
| 3,946,699 | A * | 3/1976 | Mirshak | G09F 17/00 | 116/173 |
| 4,598,661 | A * | 7/1986 | Roe | B63C 9/20 | 116/173 |
| 4,752,264 | A * | 6/1988 | Melendez | B63C 9/20 | 116/173 |

(Continued)

*Primary Examiner* — Amy Vanatta

(74) *Attorney, Agent, or Firm* — McAndrews, Held & Malloy, Ltd.

(57) ABSTRACT

Embodiments of the invention provide a water safety device used to increase participant visibility by passing water craft. The device is worn by the participant on his or her wrist and activated upon need at which time a flag is uncoiled and extended above the water. Upon conclusion of the need for visibility, the flag is replaced around the participant's wrist and ready for the next use.

7 Claims, 6 Drawing Sheets

(56) References Cited

U.S. PATENT DOCUMENTS 5,067,920 A * 11/1991 Brisky ..... B65H 75/406 114/315
5,114,369 A * 5/1992 Coffey ..... B63C 9/20 116/173
5,651,711 A * 7/1997 Samano ..... B63C 9/20 116/173
6,033,275 A * 3/2000 Ely ..... B63C 9/11 116/173
D422,397 S * 4/2000 Cohen ..... D2/858
6,058,510 A * 5/2000 Breitenbach ..... A41D 19/01594 172/371
6,749,473 B1 * 6/2004 Lower ..... B63C 9/20 116/173
6,938,275 B1 * 9/2005 Fried ..... A63B 69/0086 2/162
D570,246 S * 6/2008 Spicer ..... D11/166
7,520,074 B1 * 4/2009 Vanova ..... G09F 21/02 116/173
D607,183 S * 1/2010 Stumpfl ..... D2/858
2007/0169682 A1 * 7/2007 Boyd ..... G06F 3/005 116/173

* cited by examiner

SAFETY DEVICE FOR IMPROVED VISIBILITY OF WATER SPORTS PARTICIPANT

CROSS REFERENCE TO RELATED APPLICATIONS

This application claims the benefit of U.S. Provisional Patent Application No. 61/726,152 filed on Nov. 14, 2012, the entirety of which is herein incorporated by reference.

FEDERALLY SPONSORED RESEARCH OR DEVELOPMENT

[Not Applicable]

JOINT RESEARCH AGREEMENT

[Not Applicable]

SEQUENCE LISTING

[Not Applicable]

BACKGROUND

Water sports are a popular pastime for people of all ages and skill levels. Along with the enjoyment of activities such as water skiing, wake boarding, and tubing comes the inherent risk involved when a participant is left alone in the open water and consequently becomes invisible to passing water craft. This situation has unfortunately led to more than a few deaths.

In order to solve this problem, a device is needed that renders the water sport participant visible to area water craft and, consequently, reduces the risk involved in open water activities. Such a device should preferably be easy to use, portable, and cost effective.

SUMMARY

One or more embodiments of the invention provide a safety device that may be used in instances where a person is floating in open water as is the case when a tuber has been ejected from a tube, when a skier or wake boarder has fallen, or when a person operating a stand up paddle board, surf board, wave runner, or other water craft have become separated from the water craft.

The safety device comprises a manually operated wrist band including a thin length of semi-rigid, or preferably bi-stable, material that wraps around a user's wrist several times and is then secured with a closure strap, e.g., a Velcro® or elastic strap. When visibility is needed the closure strap is released and the band unwinds to create a mast. When the mast is extended, a flag is released providing additional visibility.

When the user has decided that visibility is no longer needed, the device is rewrapped in reverse order and secured with the closure strap.

According to certain inventive techniques, a safety device includes a wrist strap, a semi-rigid strip, a flag, and a closure. The wrist strap is configured to wrap around a wrist. The semi-rigid strip includes a proximal side attached to the wrist strap. The flag is attached to the semi-rigid strip. The closure is attached to a distal side of either the semi-rigid strip or the flag. The semi-rigid strip may include a bi-stable steel strip and/or a thin metal strip. The semi-rigid strip may measure approximately 0.75 inches to 2.0 inches in width and approximately 6 inches to 36 inches in length. The semi-rigid strip may wrap around the wrist strap and be secured in a closed, coiled position by the closure strap. The semi-rigid strip may provide, in an open, uncoiled position, a semi-rigid mast for the flag. The closure may be attached to the flag. Alternatively, the closure may be attached to the semi-rigid strip.

According to certain inventive techniques, a safety device includes a wrist strap, a base portion, a semi-rigid strip, a flag, and a closure strap. The wrist strap wraps at least partially around a user's wrist. The base portion is connected to the wrist strap. The semi-rigid strip is coiled around the base portion when the safety device is in an inactive position. The semi-rigid strip forms a mast extending away from the base when the safety device is in an active position. A flag connected to a distal side of the semi-rigid strip. The flag is wrapped around the base portion when the safety device is in the inactive position. The flag is unfurled or uncoiled when the safety device is in the active position. The closure strap is connected to the base portion and removably attachable to the base portion on one side of the closure strap. The closure strap maintains the safety device in the inactive position when the one side of the closure strap is attached to the base portion. The safety device automatically transitions from the inactive position to the active position when the one side of the closure strap is detached from the base portion.

The safety device may also include a rotatable portion rotatably attached to the base portion and attached to a proximal side of the semi-rigid strip. The proximal side of the semi-rigid strip may alternatively be attached to the base portion. The rotatable portion may have a trench that receives the semi-rigid strip when the safety device is in the inactive position. The trench may also receive the flag when the safety device is in the inactive position. The safety device may also include a fastener. The fastener may facilitate the rotatable attachment of the base portion to the rotatable portion. The fastener may also facilitate the attachment of the proximal side of the semi-rigid strip to the rotatable portion. The fastener may include a screw.

The base portion may include a hook or a peg. The closure strap may have an aperture in the one side. The one side of the closure strap may be removably attachable to the base portion via the aperture in the closure strap and the hook or peg. The semi-rigid strip may include stainless steel or coated steel. The flag may include mylar or Tyvek®. The closure strap may include rubber, silicone, or urethane.

According to certain inventive techniques, a method for operating a safety device includes coiling a semi-rigid strip into a coiled position around a wrist strap, securing the semi-rigid strip in the coiled position with a closure, releasing the closure, in response to said releasing the closure, automatically uncoiling the semi-rigid strip.

Figure 1:
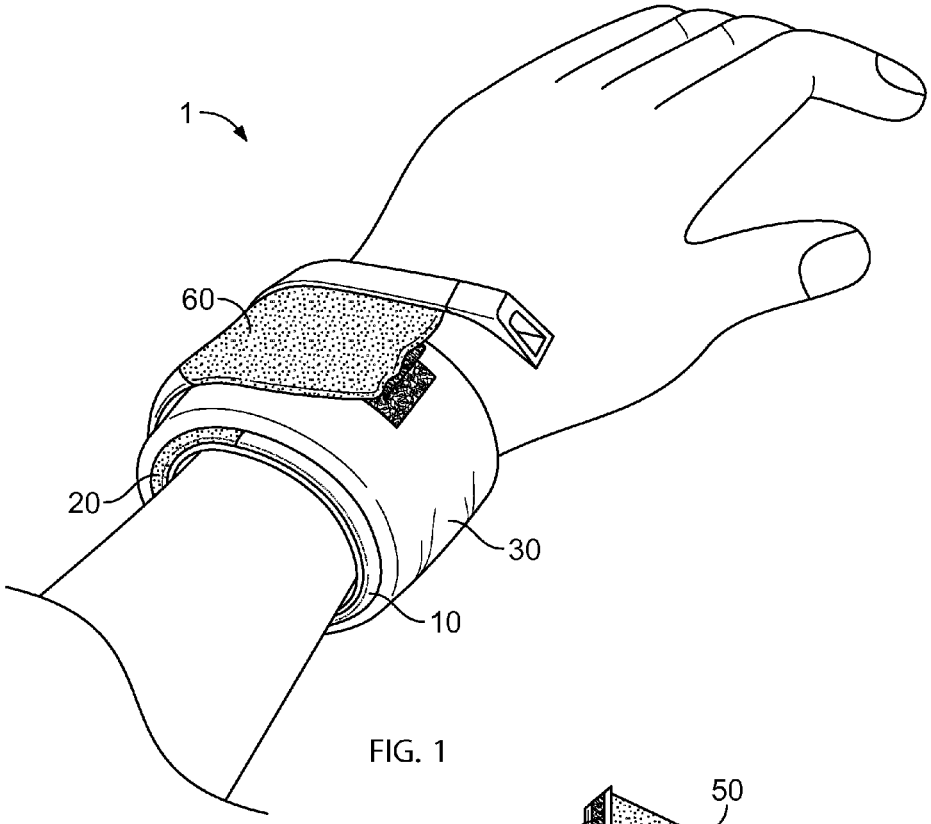
FIG. 1 shows an embodiment of a first type of safety device in an inactive position.

The foregoing summary, as well as the following detailed description of certain techniques of the present application, will be better understood when read in conjunction with the appended drawings. For the purposes of illustration, certain techniques are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION

FIGS. 1-7 illustrate a first type of safety device 1 according to certain inventive techniques. One or more embodiments of the safety device 1 comprise a wrist strap 10, which may measure approximately 9 in.×1.5 in. when laid flat. This measurement may vary depending on the size of the participant. The wrist strap 10 may comprise a webbing, which may be made of, for example, polypropylene, nylon, or cotton. The wrist strap 10 may be secured to itself to accommodate the user's wrist with a closure 20. The closure 20 may comprise mechanisms such as, for example, a hook-and-loop material (for example, Velcro®), clips, snaps, peg-and-hole (for example, like a belt and belt buckle), or the like. Alternatively, the wrist strap 10 may comprise an elastic band (for example, a closed elastic band) with a diameter sized to conform to a user's wrist.

Attached to the wrist strap 10 (for example, stitched) may be a semi-rigid strip 30, for example, a nylon encased metal strip, that may be pliable with a relatively low force to allow it to be wrapped around a user's wrist several times, but creates a mast 40 of sufficient rigidity to fly a flag 50 when fully extended. The semi-rigid strip 30 may comprise bi-stable tempered stainless steel with, or without, fiberglass fibers for additional rigidity and greater tensile strength. The steel may be coated, for example, with a mylar coating (polyethylene terephthalate), a nylon coating, Tyvek®, and/or may be encased in a sport nylon fabric. The sport nylon fabric may be waterproofed with, for example, a urethane coating. Alternatively, the semi-rigid strip 30 may comprise a bi-stable steel strip encased in silicone (similar to a slap bracelet).

The semi-rigid strip 30 when extended to create a mast 40 can be any length that provides visibility above the waterline and, yet, is not unreasonably heavy or unwieldy. In one or more embodiments, for example, the semi-rigid strip/mast 30/40 extends at least six inches, but less than approximately 36 inches, from the wrist strap 10. In one example embodiment, the semi-rigid strip/mast 30/40 extends 24 inches from the wrist strap 10.

The flag 50 may or may not be semi-rigid. According to certain inventive techniques, the flag 50 is not rigid or semi-rigid. For example, the flag 50 may comprise sport nylon with a urethane coating for waterproofing. The flag 50 may have various shapes, such as a triangle (depicted in FIGS. 2 and 7), rectangular (like a flag of a country), square, or strip-shaped (see flag 150 depicted in FIGS. 9B and 10B and discussed in more detail below).

Figure 2:
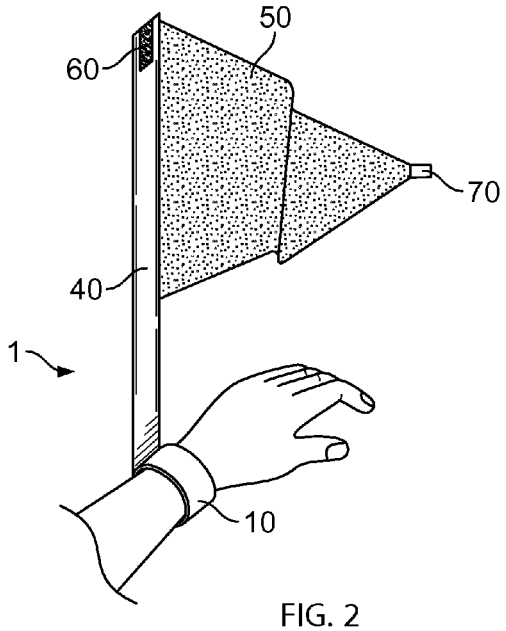
FIG. 2 illustrates an embodiment of the first type of safety device in an active position.

The flag 50 may be attached to the semi-rigid strip 30. For example, the flag 50 may be attached on a lateral side of the semi-rigid strip/mast 30/40 as depicted in FIG. 2. The flag 50 may also be attached as extending from the distal side of the strip/mast 30/40 (as depicted by flag 150 and mast 140 in FIGS. 9B and 10B). The flag 50 may be substantially permanently attached to the strip/mast. The flag 50 may also be removable or interchangeable (for example with snaps or hook-and-loop fasteners). For example, differently colored flags may be used for various safety-related purposes.

A closure 60 comprising, for example, a hook-and-loop material (for example, Velcro®) closure or elastic band is attached at or near the end/top of the semi-rigid strip/mast 30/40 to secure the semi-rigid strip when it is wrapped around a user's wrist. Other fastening mechanisms are possible such as, for example, clips, snaps, buckle and strap with holes, or the like. The flag 50 may include a narrow point at which a loop or other retention portion 70 may be located. The retention portion 70 may facilitate securing the flag 50 around the strip/mast 30/40 when the flag 50 is rolled up around the strip/mast 30/40.

FIG. 1 and FIG. 2 illustrate the safety device 1 when it is on the participant's wrist ready for use but inactive (FIG. 1) and in use and active (FIG. 2).

Figure 3:
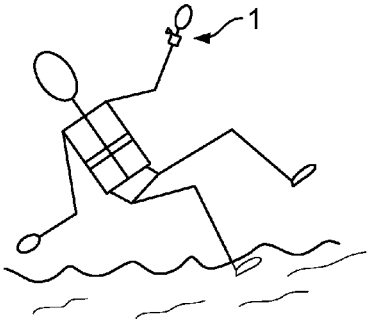
FIG. 3 demonstrates a participant engaging in activity that would benefit from an embodiment of a safety device.
Figure 4:
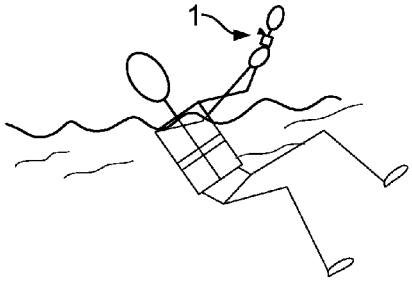
FIG. 4 depicts a participant using a safety device.
Figure 5:
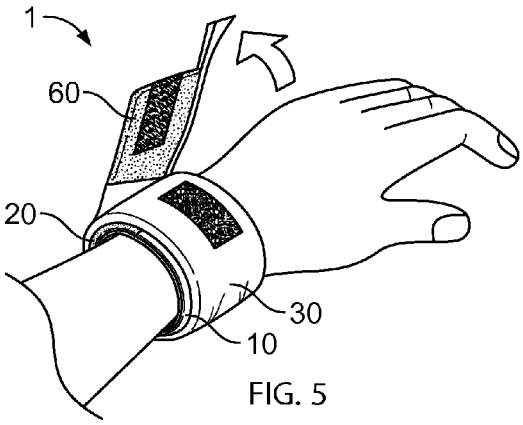
FIGS. 5 and 6 demonstrate the uncoiling action of an embodiment of the first type of safety device.
Figure 6:
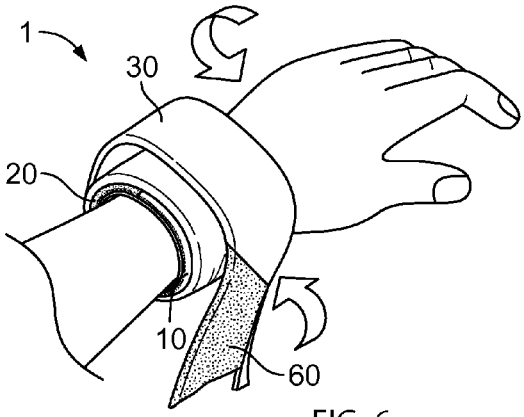

When a person participates in water sports such as water skiing and water tubing there may be points in time when a participant is left alone in the water. FIG. 3 depicts a typical scenario where a participant would end up alone in an open body of water waiting for his/her water craft to come retrieve him/her. After falling in the water and achieving stability, the user may release the closure 60 (FIG. 4). Upon release, the semi-rigid strip 30 uncoils in a circular motion (FIGS. 5 and 6) to create a mast 40. The uncoiling may be self-propelled, for example, similar to how a tape measure would uncoil. The flag 50 may also automatically uncoil (for example, if the flag 50 is attached to the distal side of the strip/mast 30/40) or unfurl (for example, if the flag 50 is attached along a lateral side of the strip/mast 30/40) during or after the uncoiling of the semi-rigid strip 30 to create the mast 40.

Figure 7:
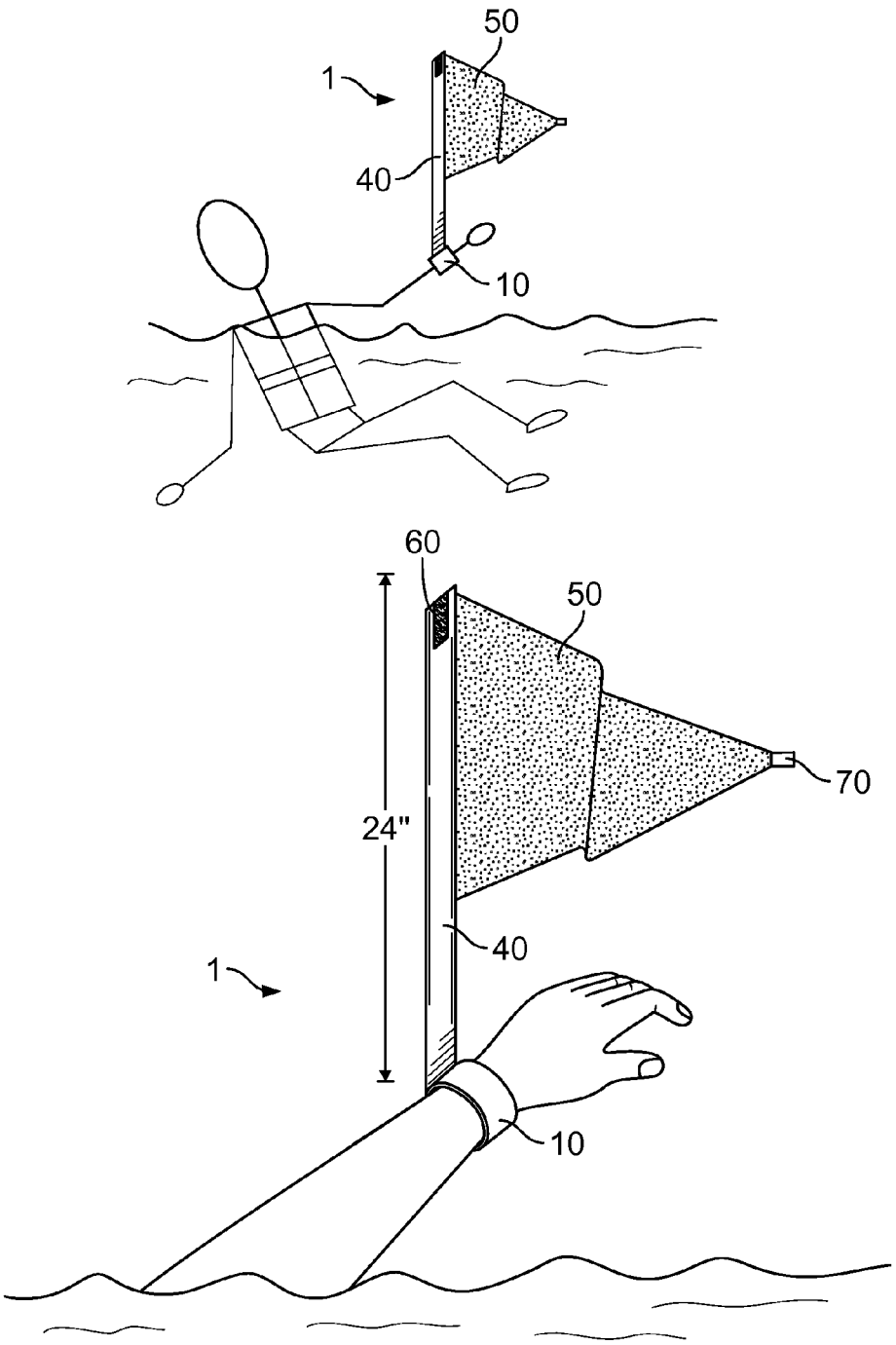
FIG. 7 illustrates a participant with the first type of safety device fully activated and a close up of the device fully activated.

Upon full extension (approximately 3 seconds) the mast 40 may maintain its rigidity and the flag 50 may extend from an upper region of the mast 40. The participant can rest his/her hand on the water, lift it slightly, or lift it over his/her head for maximum visibility. Even without elevating the hand above the water, the safety device 1 may provide significantly heightened visibility (FIG. 7). This is especially important in open water with high waves and lots of activity.

Figure 9A:
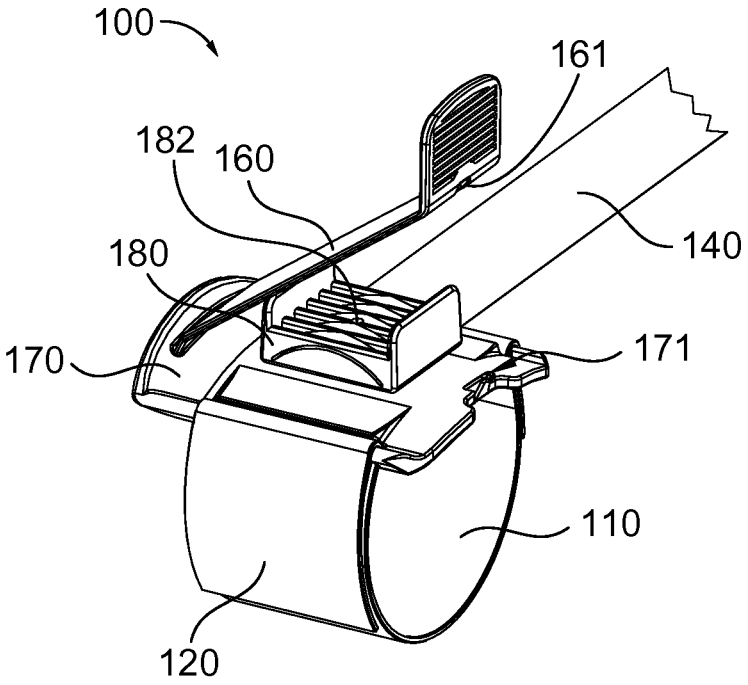
FIGS. 9A and 9B illustrate the second type of safety device in the active position.
Figure 9B:
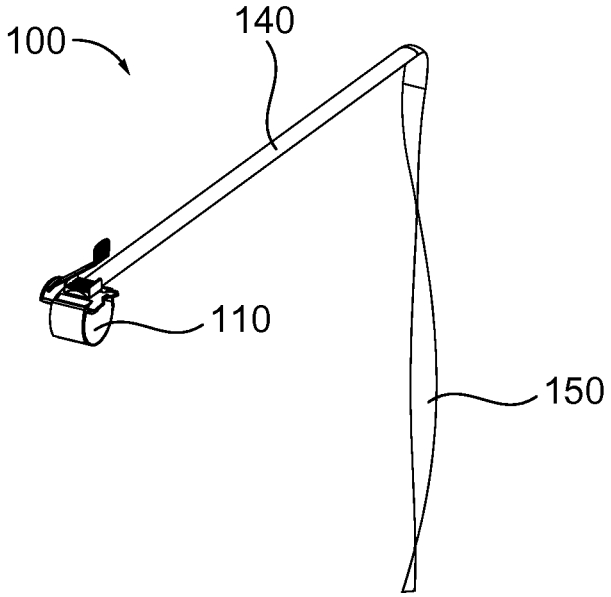
Figure 10A:
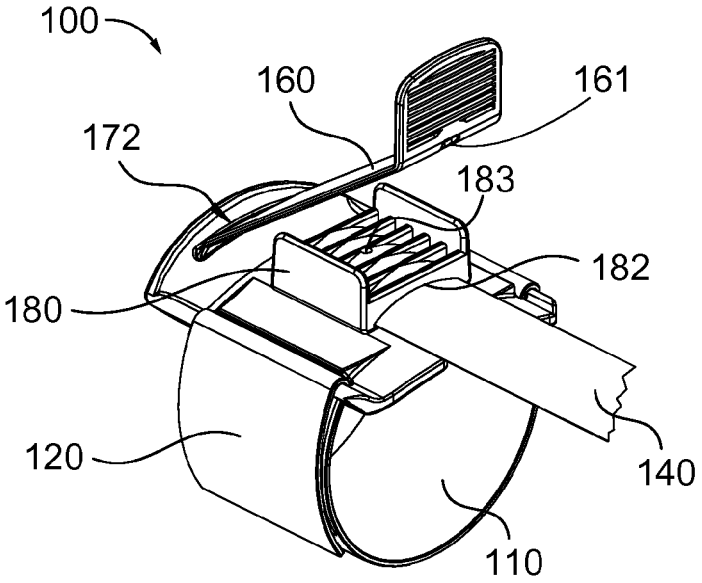
FIGS. 10A and 10B illustrate the second type of safety device in the active position after the mast and rotating plastic connector have been rotated.
Figure 10B:
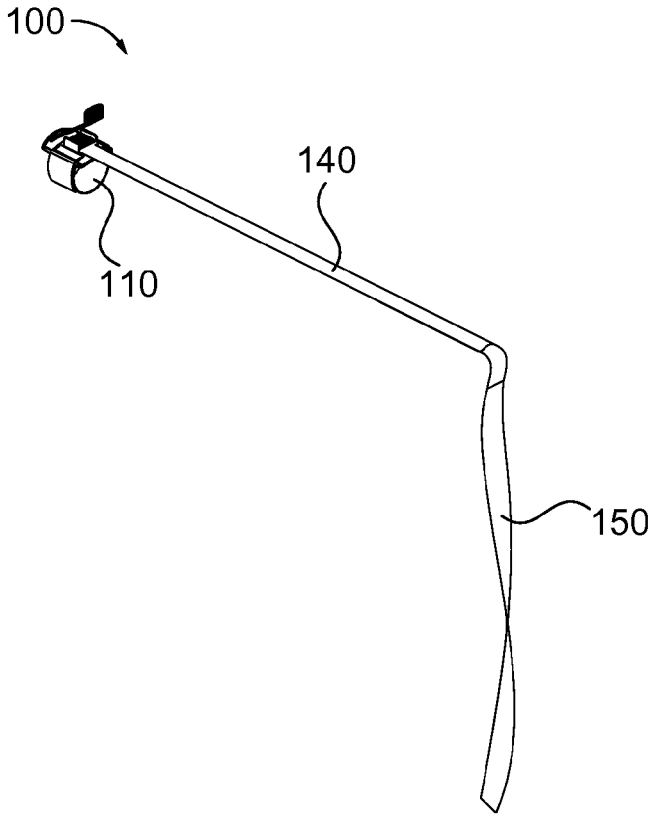

Once the participant is ready to engage in activity again, the device 1 may be returned to the inactive position. If the flag 50 is attached to a lateral side of the mast 40, the flag 50 may be rolled up around the mast 40, which is, in turn wrapped around the wrist and secured by the closure 60 in the inactive position (FIG. 1). Stowing the flag 50 in the inactive position in this manner may take less than approximately 15 seconds. Alternatively, if the flag 50 is attached to the distal side of the mast 40 (for example, as shown in FIGS. 9B and 10B with flag 150 and mast 140), it may not be necessary to roll the flag 50 around the mast 40 before wrapping the entire strip around the wrist. Instead, when the mast 40 and flag 50 form one elongated strip, the entire elongated strip may be wrapped around the wrist.

FIGS. 8A-10B illustrate a second type of safety device 100 according to certain inventive techniques. FIGS. 8A-8D illustrate a top perspective view, a bottom perspective view, a side view, and a front view of the safety device 100, respectively. The safety device 100 may include a wrist strap 110, a closure 120, a semi-rigid strip 130 (that becomes a mast 140 when unfurled), a flag 150, a closure strap 160, a base portion 170, and a rotating connector 180.

The wrist strap 110 may wrap at least partially around a user's wrist. As can be seen more clearly in FIG. 8D, the wrist strap 110 may be fed through slits in the base portion 170. On one side of the wrist strap 110 (shown in FIG. 8D as the right side of the wrist strap 110), an outer flap of the wrist strap 110 may be substantially permanently attached (for example, stitched, epoxied, riveted, or the like) to an inner portion of the wrist strap 110. The outer flap of the wrist strap 110 may also be attached by other mechanisms, such as snaps, hook-and-loop fasteners, peg-and-hole, or the like.

On another side of the wrist strap 110 (shown in FIG. 8D as the left side of the wrist strap 110), a closure flap 120 (which may be integrally formed with the wrist strap) may be adjustably attachable to the wrist strap 110. The closure flap 120 may be adjustably attachable to the wrist strap 110 through mechanisms such as hook-and-loop fasteners, peg-and-hole fasteners, snaps, or the like. This adjustment may be useful so the device 100 can fit snugly on users with different sized wrists and for ease of putting the device 100 on and taking it off.

The rotating connector 180 may be attached to the base portion 170. Both the rotating connector 180 and the base portion 170 may be formed of plastic. The rotating connector 180 may be, for example, attached to the base portion 170 by a fastener 181 such as a screw. The fastener 181 may comprise stainless steel. The fastener 181 may serve as a pivot axis about which the rotating connector 180 rotates. The rotating connector 180 may connect or engage with the semi-rigid strip 130. For example, the rotating connector 180 may include at least one slit 182 (shown as an arc-shape in FIG. 10A) that accommodates a proximal side of the semi-rigid strip 130. To attach the semi-rigid strip 130 to the rotating connector 180, the proximal side of the strip 130 may be fed through the slit 182 into an interior region of the rotating connector. An aperture may be located in the strip 130 in the proximal side. The fastener 181 may extend through the base portion 170, the aperture in the strip 130, and into a corresponding aperture 182 in the rotating connector 180. The rotating connector 180 may include two upwardly-projecting sidewalls that form a trench. This is can be seen in FIGS. 9A and 10A, where the trench is illustrated as the U-shaped recess in the top region of the rotating connector 180. The base portion 170 and/or the rotating connector 180 may include a material such as plastic, polypropylene, nylon, or the like.

Although not shown, the device 100 may be implemented without a rotating connector 180. In such a case, the semi-rigid strip 130 may be attached directly to the base portion 170. Such attachment may be achieved with a fastener similar to fastener 181. The strip 130 may be rotatably connected to the base portion 170. The strip 130 may rotate about the fastener, which may serve as a pivot axis. According to one technique, the base portion 170 may have upwardly-projecting sidewalls that form a trench.

The semi-rigid strip 130 may be similar to semi-rigid strip 30. For example, the semi-rigid strip 130 may be a nylon encased metal strip, that may be pliable with a relatively low force to allow it to be wrapped around a user's wrist several times, but creates a mast 140 of sufficient rigidity to fly a flag 150 when fully extended. The semi-rigid strip 130 may comprise bi-stable tempered stainless steel with, or without, fiberglass fibers for additional rigidity and greater tensile strength. The steel may be coated, for example, with a mylar coating (polyethylene terephthalate), a nylon coating, Tyvek®, and/or may be encased in a sport nylon fabric. The sport nylon fabric may be waterproofed with, for example, a urethane coating. Alternatively, the semi-rigid strip 130 may comprise a bi-stable steel strip encased in silicone (similar to a slap bracelet).

The flag 150 may be similar to flag 50. The flag 150 may or may not be semi-rigid. According to certain inventive techniques, the flag 150 is not rigid or semi-rigid. For example, the flag 150 may comprise sport nylon with a urethane coating for waterproofing. The flag 150 may have various shapes, such as a triangle (see flag 50 depicted in FIGS. 2 and 7), rectangular (like a flag of a country), square, or strip-shaped (see flag 150 depicted in FIGS. 9B and 10B).

The flag 150 may be attached to the semi-rigid strip 130. For example, the flag 150 may be attached on a lateral side (see, for example, FIG. 2). The flag 150 may also be attached as extending from the distal side of the strip/mast 130/140 (as depicted in FIGS. 9B and 10B). The flag 150 may be substantially permanently attached to the strip/mast 130/140. The flag 150 may alternatively be removable or interchangeable (for example with snaps or hook-and-loop fasteners). For example, differently colored flags may be used for various safety-related purposes.

The closure strap 160 may be attached to the front and back sides of the base portion 170. The closure strap 160 may be fed through a slit 172 on one side of the base portion 170. The closure strap 160 may have an enlarged portion that prevents the closure strap 160 from being able to travel all the way through the slit 172. The closure strap 160 may be fastenable to the other side of the base portion 170. For example, the closure strap 160 may have an aperture 161 that may engage with a peg or hook 171 on the base portion 170.

When the device 100 is in the inactive position, the flag 150 and the semi-rigid strip 130 may be wrapped around the wrist strap 110, the closure flap 120, the base portion 170, and the rotating connector 180. The flag 150 and the semi-rigid strip 130 may be wrapped such that a portion of each coil is received by the trench in the rotating connector 180. The semi-rigid strip 130 may be the internal region of the coil, while the flag 150 may be the external region of the coil. In other words, the flag 150, when it is attached to the distal side of the semi-rigid strip 130, may be wrapped over the coils of the semi-rigid strip 130 when the device is in the inactive position. This can be seen clearly in FIG. 8D.

Figure 8A:
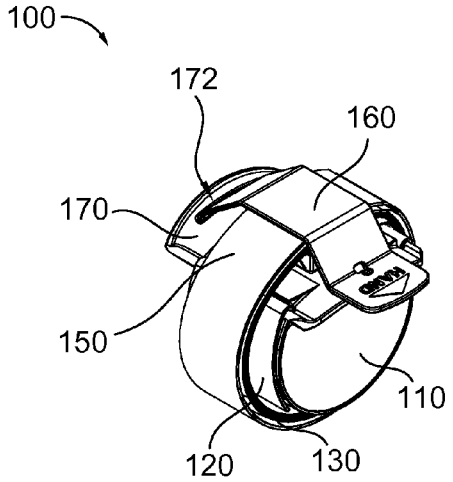
FIG. 8A illustrates a top perspective view of a second type of safety device in an inactive position.
Figure 8B:
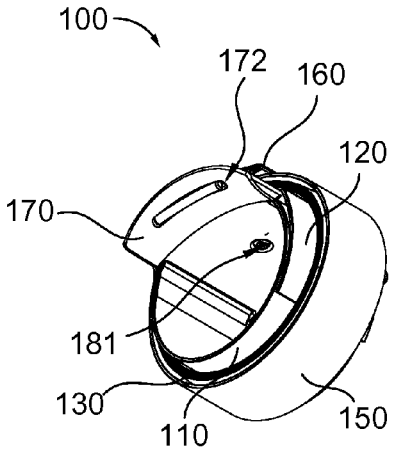
FIG. 8B illustrates a bottom perspective view of the second type of safety device in the inactive position.
Figure 8C:
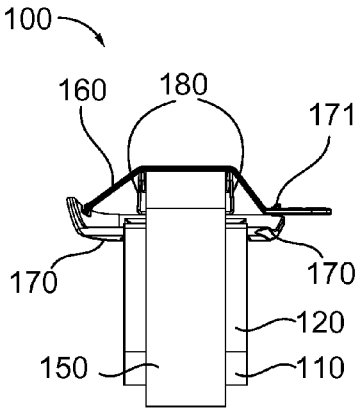
FIG. 8C illustrates a side view of the second type of safety device in the inactive position.
Figure 8D:
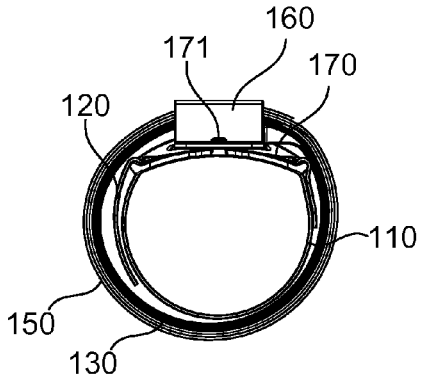
FIG. 8D illustrates a front view of the second type of safety device in the inactive position.

After the flag 150 and semi-rigid strip 130 have been wrapped around the wrist strap 110, the closure strap 160 may be pulled over the coils and attached to the base portion 170 on both sides of the closure strap 160. The closure strap 160, when connected to the base portion 170 on both of its sides, may then maintain the device 100 in the inactive position by preventing the semi-rigid strip 130 from automatically uncoiling. As shown in FIG. 8C, for example, the closure strap 160 may have a trapezoidal profile when the device 100 is in the inactive position. Such a trapezoidal profile of the closure strap 160 may be caused by the location of the lateral walls of the rotating connector 180.

When the closure strap 160 is disconnected on one side of the base portion (for example, when the aperture 161 is disengaged from the hook or peg 171), the device 100 may transition from the inactive position to an active position. This may be due to the semi-rigid nature of the strip 130. The semi-rigid strip 130 may have a general tendency to straighten or uncoil. Without the closure strap 160 to prevent such action, the semi-rigid strip 130 may uncoil automatically. This may cause the flag 150 to uncoil or unfurl as well.

FIGS. 9A and 9B illustrate the device 100 in the active position when the rotatable portion 180 has not been rotated. As can be seen in FIG. 9B, when in the active position, the semi-rigid strip 130 has formed a mast 140 which supports the flag 150. The semi-rigid strip 130 when extended to create a mast 140 can be any length that provides visibility above the waterline and, yet, is not unreasonably heavy or unwieldy. For example, the semi-rigid strip/mast 130/140 may extend at least six inches, but less than approximately 36 inches, from the rotatable portion 180 or base portion 170. In one example embodiment, the semi-rigid strip/mast 130/140 extends 24 inches from the rotatable portion 180 or base portion 170.

Per the user's preference, the rotatable portion 180 (and thusly the mast 140 which extends therefrom) may be rotated by a suitable amount such as, for example, 90 degrees as shown in FIGS. 10A and 10B. Thus, the mast 140 can be rotated with respect to the user's arm, for example, to improve the visibility of the flag while still maintaining a comfortable arm position.

According to certain inventive techniques, the device 100 may be operated in the following manner. In this example, the device 100 includes a rotatable portion 180 that has a trench. The semi-rigid strip 130 and flag 150 are coiled around the wrist strap 110, base portion 170, and rotatable portion 180. While winding, the semi-rigid strip 130 and flag 150 are layered in the trench. Then, the winding is secured in the coiled position with the closure strap 160 by engaging the closure strap 160 with the base portion 170. As needed, at least one end of the closure strap 160 is released from the base portion 170. In response to this releasing, the semi-rigid strip 130 automatically uncoils to form a mast 140.

It will be understood by those skilled in the art that various changes may be made and equivalents may be substituted without departing from the scope of the novel techniques disclosed in this application. In addition, many modifications may be made to adapt a particular situation or material to the teachings of the novel techniques without departing from its scope. Therefore, it is intended that the novel techniques not be limited to the particular techniques disclosed, but that they will include all techniques falling within the scope of the appended claims.

The invention claimed is:

1. A safety device attachable to a wearer's wrist, wherein the safety device comprises:

a wrist strap configured to wrap around the wrist;

a semi-rigid strip including a proximal side and a distal side, wherein the proximal side of the semi-rigid strip is attached to the wrist strap;

a flag attached to the semi-rigid strip;

a first closure portion attached to the distal side of at least one of the semi-rigid strip or the flag at a first location;

a second closure portion attached to a second location on the semi-rigid strip, wherein the second location is more proximal to the wrist strap than the first location as measured along the semi-rigid strip; and wherein:

when the first closure portion is engaged with the second closure portion, the closure portions together are configured to keep the semi-rigid strip coiled around the wrist; and when the first closure portion is disengaged from the second closure portion, the semi-rigid strip automatically uncoils from around the wrist such that the semi-rigid strip extends in a direction tangential to the wrist strap.

2. The safety device of claim 1, wherein the semi-rigid strip comprises a bi-stable steel strip.

3. The safety device of claim 1, wherein the semi-rigid strip comprises a thin metal strip.

4. The safety device of claim 1, wherein the semi-rigid strip measures approximately 0.75 inches to 2.0 inches in width and approximately 6 inches to 36 inches in length.

5. The safety device of claim 1, wherein the semi-rigid strip is configured to provide, in an open, uncoiled position, a semi-rigid mast for the flag.

6. The safety device of claim 1, wherein the first closure portion is attached to the flag.

7. The safety device of claim 1, wherein the first closure portion is attached to the semi-rigid strip.

* * * * *